United States Patent [19]

Mazouet et al.

[11] 4,210,403

[45] Jul. 1, 1980

[54] INKING RIBBON CARTRIDGE HAVING FEED ROLLERS WITH DIFFERENT SURFACE HARDNESS

[75] Inventors: Joel Mazouet, Schweitzer-Belfort; Jean-Claude Michaux, Hericourt; Jean Mahe, Champigny, all of France

[73] Assignee: Compagnie Internationale pour l'Informatique Cil-Honeywell Bull (Societe Anonyme), Paris, France

[21] Appl. No.: 899,723

[22] Filed: Apr. 25, 1978

[30] Foreign Application Priority Data

May 17, 1977 [FR] France ..... 77 15118

[51] Int. Cl.[2] ..... B41J 33/10

[52] U.S. Cl. ..... 400/196.1; 400/235.1; 400/636; 400/641

[58] Field of Search ..... 400/194, 195, 196, 196.1, 400/207, 208, 208.1, 235.1, 636, 641

[56] References Cited

U.S. PATENT DOCUMENTS

| | | | |
|---|---|---|---|
| 625,616 | 5/1899 | Uhlig | 400/636 |
| 944,746 | 12/1909 | Rice | 400/641 |
| 1,098,840 | 6/1914 | Rennie | 400/641 |
| 3,042,179 | 7/1962 | Stern | 400/641 X |
| 3,430,748 | 3/1969 | Parri | 400/636 X |
| 3,973,707 | 8/1976 | Pratt et al. | 400/196.1 X |
| 3,974,906 | 8/1976 | Lee et al. | 400/196.1 |
| 3,977,512 | 8/1976 | Teagarden et al. | 400/196.1 X |
| 4,011,933 | 3/1977 | Kern | 400/208 |
| 4,053,042 | 10/1977 | Hess | 400/196 |
| 4,091,914 | 5/1978 | Stipanuk | 400/196.1 |

FOREIGN PATENT DOCUMENTS

| | | | |
|---|---|---|---|
| 677518 | 6/1939 | Fed. Rep. of Germany | 400/641 |

*Primary Examiner*—Ernest T. Wright, Jr.

*Attorney, Agent, or Firm*—Kerkam, Stowell, Kondracki & Clarke

[57] ABSTRACT

An inking ribbon cartridge for printers having two rollers between which a flexible film ribbon is drivingly engaged. The rollers are provided on their outer faces with a friction material, with the hardness of the friction material on the roller in contact with the inked face of the ribbon being higher than that of the friction material in contact with the other face of the ribbon. The friction material may be formed by a synthetic material such that the ratio between the hardnesses of the friction materials on the two rollers is between a half and two-thirds. The friction material on each of the two rollers may be formed by a polychloroprene such that the Shore hardness of the friction material on the roller in contact with the inked face of the ribbon is between 60 and 110.

7 Claims, 3 Drawing Figures

INKING RIBBON CARTRIDGE HAVING FEED ROLLERS WITH DIFFERENT SURFACE HARDNESS

BACKGROUND OF THE INVENTION

1. Field of the Invention

The present invention relates to an inking ribbon cartridge intended for use in printers or similar machines such as, for example, typewriters or teleprinters.

2. Description of the Prior Art

Inked ribbon cartridges are well known in present day technology. One example of an inked ribbon cartridge is in French patent no. 2,155,539. As disclosed in that patent, the cartridge is formed by a casing for housing a rotatable delivery spool and take-up spool. To this end, the casing is provided with two openings to allow the ribbon the pass out to the exterior of the casing and with two projecting support members arranged at the points where the openings are siutated to guide the section of the ribbon lying outside the casing so that this section can be moved along a print line between the paper and the raised printing characters in relief of the machine. The inked ribbon is driven by two rollers between which the ribbon is engaged and which respectively drive and apply pressure to the ribbon. These two rollers are arranged in the casing on the same side as the opening situated near the take-up spool.

Such inked ribbon cartridges are not entireiy satisfactory owing to the fact that, to wind the ribbon onto the take-up spool, they require a drive arrangement which is different from that which operates the drive roller. The result is that a machine which uses such a cartridge needs to be fitted with a particularly complicated and expensive drive mechanism. In addition, in such cartridges the ribbon has to be completely rewound, or even replaced, once it has been fully unwound from the delivery spool, which makes it necessary to stop the machine to perform the appropriate operations.

To overcome these disadvantages, a proposal has been made for an inked ribbon cartridge in which the delivery and take-up spools are dispensed with. The ribbon is stored in the casing and in a randomly folded state. In this cartridge the drive to the ribbon is provided by two toothed pinions between which the ribbon is engaged, with guiding and friction means being provided to enable the ribbon to feed out regularly from the casing. Such an arrangement is described and illustrated in French Pat. No. 2,188,505.

This cartridge, which is very suitable in cases where the ribbon is formed by a strip of one-shot carbon paper, proves difficult to use however when the ribbon is formed by an endless strip of fabric owing to the fact that such a ribbon, which is deformed in the course of its passages between the toothed pinions, eventually wears rather rapidly. There is then a danger of the ribbon arranging itself incorrectly in the casing and tangling or even breaking. In addition, such a cartridge appears totally unsuitable for use with an endless ribbon which, when formed from a material such as paper or plastics material for example, retains at least some traces of the deformation to which it is subjected. Also, and perhaps most objectionable is the tendency of the ribbon to stick to the friction rollers.

SUMMARY OF THE INVENTION

The present invention overcomes all these disadvantages and provides an inking ribbon cartridge of simple construction which contains no spools and which is able to use an endless inking ribbon made of a material such as paper, fabric, plastics or some other material.

One object of the invention is to provide an improved inking ribbon cartridge for printers or the like in which the drive to the ribbon is provided by two rollers between which the ribbon is engaged, the said cartridge being characterized in that the said rollers are provided on their outer faces with a friction material, the hardness of the friction material on one of the rollers being different from that of the friction material on the other.

BRIEF DESCRIPTION OF THE DRAWING

Other features and advantages of the invention will become apparent from a perusal of the following description which is given by way of non-limiting example, and by reference to the accompanying drawing, in which.

DESCRIPTION OF THE PREFERRED EMBODIMENTS

Figure 1:
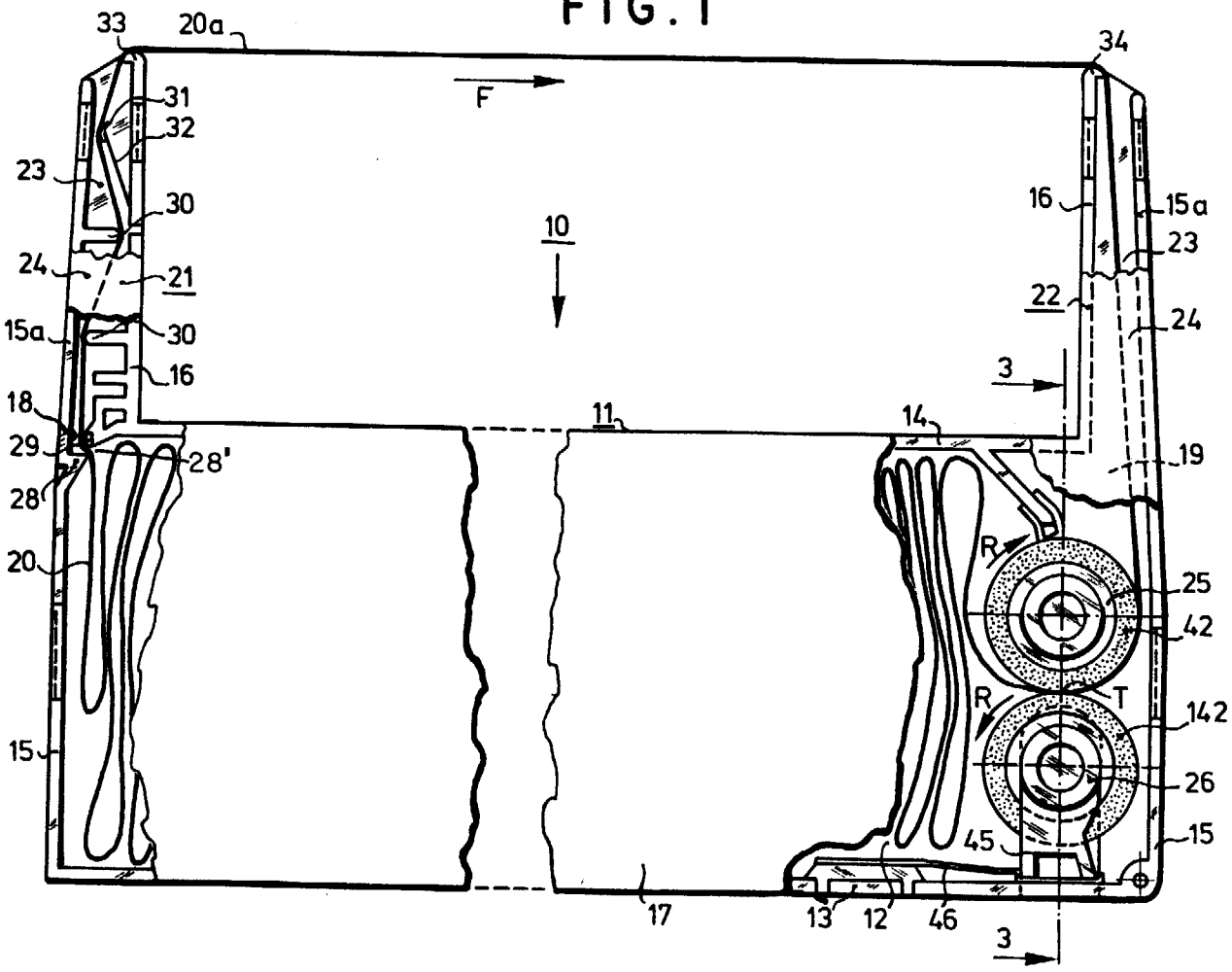
FIG. 1 is a front view, partly cut-away, of an inking ribbon cartridge formed in accordance with the invention.

The inking ribbon cartridge which is shown in FIG. 1, and which is referred to in generaly by reference numberal 10, has a casing 11, which is virtually in the shape of a right-angled parallelepiped and which consists of a base 12, a front wall 13, a rear wall 14, two side walls 15 which are perpendicular to walls 13 and 14, and a cover 17 which closes off the top of the casing 11. At the two ends of the rear wall 14 are located two openings marked 18 and 19, which provide a passage for an inked ribbon 20. At the points where openings 18 and 19 are situated, the casing 11 has two support members 21 and 22 which project from the rear wall 14 and which are used to guide the section **20*a* of the ribbon 20 which lies outside the casing 11. In the embodiment described, each of these support members 21 and 22 is formed by a hollow conduit which is bounded on the one hand by two side-walls 15*a* and 16 which are substantially parallel to one another and of which one, 15*a*, forms a continuation of the side wall 15, and on the other hand by a lower boundarywall 23 and an upper boundary wall 24 which are formed by continuations of the base 12 and the cover 17 respectively. This being the case, the section 20*a* of the ribbon 20, which is tensioned in a manner which will be explained below between the free ends 33 and 34 of the side walls 16 of the two support members 21 and 22, is properly guided when the ribbon 20** is driven in the direction indicated by arrow F in FIG. 1.

As can be seen in FIG. 1, the inked ribbon 20 is arranged in a folded vertical position inside the casing 11, that is to say perpendicularly to the base 12 and the cover 17. The ribbon 20, which is stored in the casing 11 in a very large number of loops, is made of a material which is sufficiently flexible not to prevent the loops from forming, while at the same time allowing the ribbon 20 stored in the casing 11 to remain substantially perpendicular to the base 12 and the cover 17. Thus, in the embodiment being described, the ribbon 20 is formed from a synthetic resin which is sold commercially under the registered trademark "Mylar", but it is understood that the ribbon 20 could be formed from any other suitable material, such as a strip of carbon coated paper or again a strip of fabric which is impregnated with ink and attached to a film of snythetic material. This being the case, the ribbon 20 which is situated inside the casing 11 has two faces of which only one is inked. It should also be mentioned that, in the embodiment being described, the inked ribbon 20 which is located in the cartridge 10 is an endless ribbon. However, for certain particlar applications such as the printing or magnetizable characters consisting of bars for example, the ribbon 20 could be formed by a one-shot ribbon such as for example a dry ribbon whose ink transfers totally.

Figure 2:
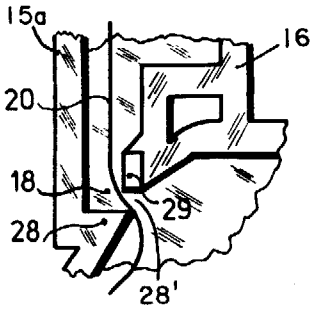
FIG. 2 is a detail view of part of the cartridge shown in FIG. 1.

FIG. 1 also shows that the cartridge 10 is provided with two rollers 25, 26 arranged inside the casing 11 on the same side as opening 19. These rollers 25, 26 engage the ribbon 20 between them and cause the ribbon 20 to be fed along in the direction of arrow F. It will be realized that when the rollers 25, 26 are driven in rotation in the direction indicated by arrows R in FIG. 1, the ribbon 20, being drawn along by the rollers 25, 26, leaves the casing 11 through opening 18, passes through the support member 21, crosses the space between members 21 and 22 and, having passed through support member 22, re-enters the casing 11 through opening 19. To enable the ribbon 20 to feed out regularly from the casing 11 through opening 18 and to remain tensioned until it has passed between rollers 25 and 26, the cartridge 10 is provided with guiding and friction means which, in the embodiment being described, are formed on the one hand by a wedge-shaped protuberance 28 (FIGS. 1 and 2) which is carried by side wall 15 near opening 18 and by a part 29 which is so disposed as to leave only a small space or restricted passage 28' for the passage of the ribbon 20 between it and the protuberance 28, and on the other hand by webs 30 which, being formed on the side walls 15a and 16 of support member 21 project towards the center of support member 21 so as to compel the ribbon 20 which passes through the member 21 to move first towards wall 15a and then towards wall 16 in a zig-zag pattern. The support member 21 is also provided with a felt pad 31 which is biased, by a leaf spring 32, against the un-inked face of the ribbon 20. The action of pad 31 serves to maintain this face free of any dust when it arrives opposite the strike hammers of an associated printer, that is to say in the area situated between the two ends 33 and 34 of the support members 21 and 22.

After having passed through the area situated between the ends 33 and 34, the ribbon 20, driven along by rollers 25 and 26, is drawn into support member 22 and makes its way into the interior of the casing 11, where it then passes between rollers 25 and 26. After this, still being driven forward by these same rollers 25, 26, it collects in the casing 11 in the form of folded loops, as can be seen in FIG. 1. This method of collection enables a relatively great length of ribbon 20 to be stored in the casing 11.

Figure 3:
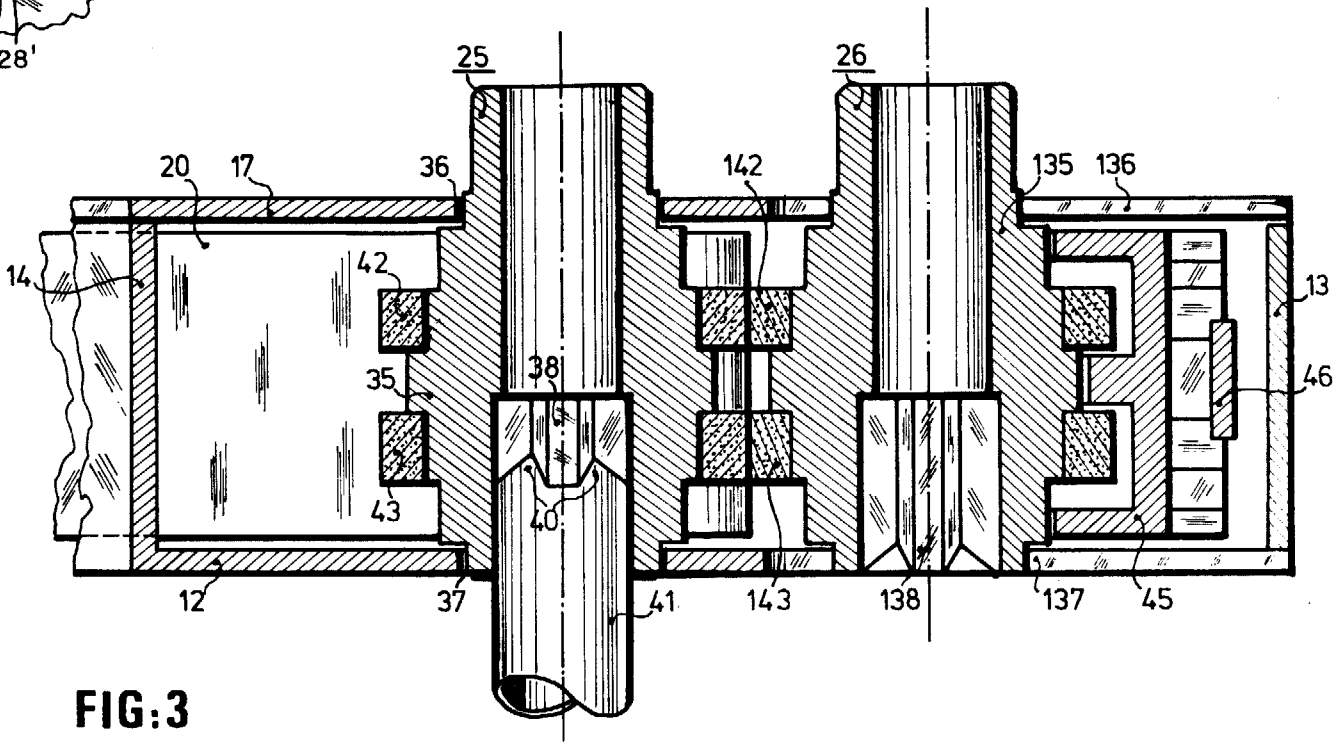
FIG. 3 is a sectional view, on the chain line shown in FIG. 1 and looking in the direction of arrows 3—3 of the cartridge shown in FIG. 1.

Referring to FIG. 3, it will be seen that roller 25 has a cylindrical hub 35 which passes through two openings 36 and 37 formed in the cover 17 and the base 12, respectively, of the casing 11. In the portion lying between the base 12 and the cover 17, the diameter of the hub 35 is greater than the width of the openings 36 and 37, which prevents it from escaping from the casing 11, but allows it to rotate freely on its axis. The hub 35 is provided with grooves 38 which can be brought into engagement with suitably shaped teeth 40 on a drive shaft 41 of the machine to which the cartridge 10 is fitted. As shown in FIG. 3, the hub 35 has fixed to it two coaxial rings 42 and 43 of the same diameter, the two rings 42,43 being made of a material whose composition will be hereinafter described.

As can be seen in FIG. 3, the roller 26 is formed in a similar way to roller 25 and each of the parts of which it is made up is referred to by the same reference numeral as is used to designate a similar part of roller 25, but prefixed by the numeral 1. Thus, the hub of roller 26 is identified with reference character 135 and corresponds to the hub 35 of roller 25. This hub 135 passes through two openings 136 and 137 of oblong shape which are formed in the cover 17 and the base 12 respectively of the casing 11. The hub 135, whose shape is identical to that of hub 35, is, in the portion ccontained between the base 12 and the cover 17, of larger diameter than the openings 136 and 137, which prevents it from escaping from the casing 11 but allows it to turn freely on its axis and to slide in the direction of elongation of the openings 136 and 137. The roller 26, which is thus guided by the lateral edges of the two openings 136, 137, is urged against roller 25 by a pressure device formed by a U-piece 45 attached to one of the ends of a leaf spring 46 whose other end is fixed to the front wall 13. Like hub 35, the hub 135 of roller 26 is provided with grooves 138 and two coaxial rings 142 and 143, which, under the prompting of the pressure member 45, are urged towards rings 42 and 43 respectively of roller 25. This being the case, the inked ribbon 20 which passes between rollers 25 and 26 is gripped between ring 42 and 142 and rings 43 and 143, as shown in FIG. 3. The result is that when roller 25, driven by shaft 41, turns in the direction indicated by arrow R in FIG. 1, the portion of the ribbon 20 which lies in the support members 21 and 22 and in the space between these two members 21, 22 is subjected to traction and moves in the direction of arrow F, tension in this portion being ensured by the friction which is exerted on the ribbon 20 by the protuberance 28, the part 29, the webs 30 and the pad 31.

Rings 42 and 43 of roller 25 are preferably made of a material whose hardness is different from that of the material forming the rings 141 and 143 of roller 26. This material ensures that the inked ribbon 20 is driven without slip and is generally formed by natural rubber or a synthetic material capable of undergoing deformation and then returning substantially to its original shape. A synthetic material of this nature, which is known as an alastomer, may for example, be that produced by polymerizing butadiene or chloroprene. Thus, in the preferred embodiment described, the synthetic material is formed by a polychloroprene which is marketed under the name "Neoprene" (registered trademark).

The material forming the rings 42 and 43 differs in hardness from the material forming the rings 142 and 143. To this end, there is incorporated in the material certain substances, such as plasticizers for example, the effect of which is to alter its hardness. It should be mentioned that the hardness concerned in the present case is Shore hardness, which is found by measuring the depth to which a conical point on which a spring exerts a constant load penetrates into the material in a period of 30 seconds. In cases where the inked ribbon 20 is formed by a flexible plastic film one of whose faces is inked, the hardness of the material forming the rings which are in contact with this inked face is greater than that of the material forming the rings which are in contact with the other face of the ribbon 20.

In a particularly advantageous embodiment, the hardness of the rings 142, 143 which are in contact with the un-inked face of such a ribbon 20 is between half and two-thirds the hardness of the rings 142, 143 which are in contact with the inked face of the ribbon 20. Thus, in the embodiment being described, where the ribbon 20 is formed by a film of "Mylar" one of whose faces is inked and where the Shore hardness of the rings 142 and 143 which are in contact with this inked face is equal to 90, the Shore hardness of the material forming ring 42 and 43 is equal to 50, that is to say is between the two extreme values $90/2=45$ and $(90\times2)/3=60$. It should however be mentioned that the hardness of the material forming rings 142 and 143 is not restricted to the value which has just been mentioned and that, to drive a ribbon 20 of the kind mentioned above, the rings 142 and 143 could be produced using an elastomer whose Shore hardness is between 60 and 110, the Shore hardness of the material forming the rings 42 and 43 consequently being between 30 and 70.

It has been found that, in the inked ribbon cartridge 10 which has just been described, in which the hardness of the friction material of one of the two rollers 25, 26 is different from that of the friction material of the other roller, the tendency of the ribbon 20 to stick to one or the other of the two rollers 25, 26 is virtually eliminated. This being the case, the inked ribbon 20, having passed between rollers 25 and 26, disengages from them in practice at a point T which is situated, as shown in FIG. 1, in the plane which passes through the axes of rotation of the two rollers 25, 26.

While the invention has been defined with respect to a particular embodiment, it should be noted that the description is not given by way of limitation and other variations will suggest themselves to those having ordinary skill in the art and for a full appreciation of the full scope and true spirit of the invention resort should be made to the appended claims.

We claim:

1. An inking ribbon cartridge for printers or the like, comprising:

a casing for housing an inking ribbon, said casing having a ribbon entrance opening and a ribbon exit opening;

a first projecting support member disposed at said exit opening and a second projecting support member disposed at said entrance opening, each of said support members being formed by a hollow conduit having one of its two ends in communication with said casing;

said inking ribbon being received within said casing and arranged in random loops, said ribbon passing through said support members and extending across the open space between the other ends of said support members, said ribbon having two faces, one of which is inked;

guiding and friction means disposed inside said first support member for providing a substantially constant drag force on said ribbon; and ribbon transport means arranged inside said casing for translating said ribbon from said exit opening to said casing via said support members and said entrance opening, said transport means including a rotatably supported drive roller and an idler pressure roller for engaging said ribbon therebetween, each of said rollers comprising at least a ring made of resilient elastomeric material, the hardness of the elastomeric material forming the ring of said drive roller being different from that of the elastomeric material forming the ring of said pressure roller.

2. An inking ribbon cartridge for printers or the like, comprising:

a casing for housing an endless inking ribbon, said casing having a ribbon entrance opening and a ribbon exit opening;

a first projecting support member disposed at said exit opening and a second projecting member disposed at said entrance opening, each of said support members being formed by a hollow conduit having one of its two ends in communication with said casing;

said endless inking ribbon being received within said casing and arranged in random loops, said ribbon passing through said support members and extending across the open space between the other ends of said support members, said ribbon having two faces, one of which is inked;

guiding and friction means disposed inside said first support member for providing a substantially constant drag force on said ribbon; and ribbon transport means arranged inside said casing for translating said ribbon from said exit opening to said casing via said support members and said entrance opening, said transport means including a rotatably supported drive roller and an idler pressure roller for engaging said ribbon therebetween, each of said rollers comprising at least a ring made of resilient synthetic material the hardness of the resilient material forming the ring of said drive roller being different from that of the resilient material forming the ring of said pressure roller.

3. An inking ribbon cartridge for printers or the like, comprising:

a casing for housing an endless inking ribbon, said casing having a ribbon entrance opening and a ribbon exit opening;

a first projecting support member disposed at said exit opening and a second projecting support member disposed at said entrance opening, each of said support members being formed by a hollow conduit having one of its two ends in communication with said casing:

said endless inking ribbon being disposed within said casing and arranged in random loops, said ribbon passing through said support members and extending across the open space between the other ends of said support members, said ribbon being formed by a flexible film of plastics material of which one face is inked;

guiding and friction means disposed inside said first support member for providing a substantially constant drag force on said ribbon; and ribbon transport means arranged inside said casing for translating said ribbon from said exit opening to said casing via said support members and said entrance opening, said transport means including a rotatably supported drive roller and an idler pressure roller for engaging said ribbon therebetween, each of said rollers comprising at least a ring made of a resilient elastomeric material, the hardness of the resilient material forming the ring in contact with the inked face of said ribbon being higher than that of the resilient material forming the ring in contact with the non-inked face of that ribbon.

4. An inking ribbon cartridge according to claim 3, wherein the value of the hardness of the resilient material forming the ring in contact with the inked face of the ribbon is comprised between 1.5H and 2H, H being the Shore value of the hardness of the resilient material forming the ring in contact with the non-inked face of that ribbon.

5. An inking ribbon cartridge for printers or the like comprising:

a casing for housing an endless inking ribbon, said casing having a ribbon entrance opening and a ribbon exit opening;

a first projecting support member disposed at said exit opening and a second projecting support member disposed at said entrance opening, each of said support members being formed by a hollow conduit having one of its two ends in communication with said casing;

said endless inked ribbon being received within said casing and arranged in random loops, said ribbon passing through said support members and extending across the open space between the other ends of said support members, said ribbon being formed by a flexible film of plastics material of which one face is inked;

guiding and friction means disposed inside said first support member for providing a substantially constant drag force on said ribbon; and ribbon transport means arranged inside said casing for translating said ribbon from said exit opening to said casing via said support members and said entrance opening, said transport means including a rotatably supported drive roller and an idler pressure roller for engaging said ribbon therebetween, each of said rollers comprising at least a ring made of a material formed by a polychloroprene, the hardness of the material forming the ring in contact with the inked face of said ribbon being higher than that of the material forming the ring in contact with the non-inked face of that ribbon.

6. An inking cartridge according to claim 5, wherein the Shore Hardness of the material forming the ring in contact with the inked face of the ribbon is comprised between 1.5H and 2H, H being the Shore hardness of the material forming the ring in contact with the non-inked face of that ribbon.

7. An inking ribbon cartridge according to claim 5, wherein the Shore Hardness of the material forming the ring in contact with the inked face of the ribbon is between 60 and 110.

* * * * *